US011898793B2

(12) United States Patent
Xu et al.

(10) Patent No.: US 11,898,793 B2
(45) Date of Patent: Feb. 13, 2024

(54) VERTICAL DISPLACEMENT STOPPING SYSTEM

(71) Applicant: WUXI HAIDAER PRECISION SLIDES CO., LTD, Jiangsu (CN)

(72) Inventors: Xinglong Xu, Jiangsu (CN); Haiwen Zhang, Jiangsu (CN); Lian Zou, Jiangsu (CN); Kai Dai, Jiangsu (CN); Feng Qian, Jiangsu (CN); Qiang Ji, Jiangsu (CN)

(73) Assignee: WUXI HAIDAER PRECISION SLIDES CO., LTD, Jiangsu (CN)

( * ) Notice: Subject to any disclaimer, the term of this patent is extended or adjusted under 35 U.S.C. 154(b) by 45 days.

(21) Appl. No.: 17/641,420

(22) PCT Filed: May 6, 2020

(86) PCT No.: PCT/CN2020/088714
§ 371 (c)(1),
(2) Date: Mar. 8, 2022

(87) PCT Pub. No.: WO2021/184503
PCT Pub. Date: Sep. 23, 2021

(65) Prior Publication Data

US 2022/0299259 A1 Sep. 22, 2022

(30) Foreign Application Priority Data

Mar. 20, 2020 (CN) ..... 202010201386.8

(51) Int. Cl.
*F25D 25/02* (2006.01)
*A47B 57/06* (2006.01)
(Continued)

(52) U.S. Cl.
CPC ..... *F25D 25/025* (2013.01); *F25D 25/04* (2013.01); *F25D 11/00* (2013.01); *F25D 23/04* (2013.01); *F25D 25/02* (2013.01)

(58) Field of Classification Search
CPC ..... F25D 25/025; F25D 25/04; F25D 23/04; F25D 25/02; F25D 25/024; F25D 23/067;
(Continued)

(56) References Cited

U.S. PATENT DOCUMENTS 5,913,584 A * 6/1999 Swindell ..... F25D 25/02 248/292.12
7,306,303 B2 * 12/2007 Ritchie ..... F25D 25/024 248/244
(Continued)

FOREIGN PATENT DOCUMENTS

CN 104490108 A 4/2015
CN 104515353 A 4/2015
(Continued)

*Primary Examiner* — Kimberley S Wright

(57) ABSTRACT

A vertical displacement stopping system includes a sliding guide mechanism, a locking mechanism and a bearing mechanism. The locking mechanism, having positioning holes, includes positioning pins, telescopic mechanisms, and a handle located at a front portion of the bearing mechanism, wherein the handle is connected with the positioning pins through transmission parts, respectively. Each of the telescopic mechanisms includes a housing having a chamber, a movable block located within the chamber, and a reset spring located between a top portion of the movable block and the housing, wherein each of the transmission parts is connected with each of the positioning pins through the movable block.

3 Claims, 7 Drawing Sheets

(51) Int. Cl.

| | |
|---|---|
| ***A47B 96/02*** | (2006.01) |
| ***F25D 25/04*** | (2006.01) |
| *F25D 11/00* | (2006.01) |
| *F25D 23/04* | (2006.01) |

(58) Field of Classification Search
CPC ..... F25D 11/00; A47B 96/06; A47B 57/06; A47B 57/30
See application file for complete search history.

(56) References Cited

U.S. PATENT DOCUMENTS

| | | | | |
|---|---|---|---|---|
| 10,161,671 | B2 * | 12/2018 | Chellappan | F25D 25/024 |
| 10,314,393 | B2 * | 6/2019 | Abeygunawardana | A47B 57/06 |
| 10,578,350 | B2 * | 3/2020 | Yao | F25D 25/024 |
| 2001/0025508 | A1 * | 10/2001 | Nakajima | F25D 25/02 62/440 |
| 2004/0263037 | A1 * | 12/2004 | Ritchie | F25D 25/024 312/405.1 |
| 2018/0306490 | A1 * | 10/2018 | Chellappan | F25D 11/02 |
| 2019/0212054 | A1 * | 7/2019 | Yao | F25D 23/067 |

FOREIGN PATENT DOCUMENTS

| | | | | |
|---|---|---|---|---|
| KR | 20060077404 | A | | 7/2006 |
| KR | 20090125317 | A | * | 12/2009 |
| KR | 20100065501 | A | * | 6/2010 |
| KR | 20100065511 | A | * | 6/2010 |
| KR | 20100070512 | A | * | 6/2010 |

* cited by examiner

VERTICAL DISPLACEMENT STOPPING SYSTEM

CROSS REFERENCE OF RELATED APPLICATION

This is a U.S. National Stage under 35 U.S.C 371 of the International Application PCT/CN2020/088714, filed May 6, 2020, which claims priority under 35 U.S.C. 119(a-d) to CN 202010201386.8, filed Mar. 20, 2020.

BACKGROUND OF THE PRESENT INVENTION

Field of Invention

The present invention relates to the technical field of refrigerator structures, and more particularly to a vertical displacement stopping system.

Description of Related Arts

In the existing technology, in order to make more reasonable use of space during use, the tray in the refrigerator compartment and the small drawer on the refrigerator door are able to be moved up and down. However, when the tray is too large, the load is too much and items carried by the tray are easy to roll, it is required for moving the tray or the drawer to take out all items therein. After the tray or drawer moves to the target position, the items are put back into the tray or drawer again. The whole process is quite cumbersome. In addition, grids for fixing the tray or the drawer are small in number and large in spacing, so that the tray or drawer is unable to be adjusted finely, and the space is unable to be used to the greatest extent.

The Chinese patent with application number CN 201310461942.5 discloses an adjustable shelf for a refrigerator, which comprises a shelf body and a lifting adjustment mechanism, wherein the shelf body is supported on a support frame by two brackets, and the two brackets are able to move up and down corresponding to the support frame, the support frame has a plurality of positioning holes, multiple positioning pins are provided on the support frame and are inserted or removed from the positioning holes through a telescopic mechanism. However, the brackets and the telescopic mechanism mentioned above are located at the end, which is inconvenient for the user to operate.

SUMMARY OF THE PRESENT INVENTION

Technical Problems

Aiming at the inconvenience of adjusting trays or drawers of existing refrigerators, the present invention provides a vertical displacement stopping system, which is able to easily adjust the position of the load.

Technical Solutions

The present invention provides technical solutions as follows.

A vertical displacement stopping system comprises a sliding guide mechanism, a locking mechanism and a bearing mechanism, wherein the locking mechanism, having positioning holes, comprises positioning pins, telescopic mechanisms, and a handle located at a front portion of the bearing mechanism, wherein the handle is connected with the positioning pins through transmission parts, respectively; each of the telescopic mechanisms comprises a housing having a chamber, a movable block located within the chamber, and a reset spring located between a top portion of the movable block and the housing, wherein each of the transmission parts is connected with each of the positioning pins through the movable block.

Preferably, the handle is slidably connected with a bottom of the bearing mechanism, the housing is located at a bottom end of the bearing mechanism, each of the housing and the bearing mechanism has a through-hole for allowing the each of the positioning pins to pass through, the movable block is connected with a guide rod, the reset spring is sleeved outside the guide rod, the housing has another through-hole for allowing the guide rod to pass through;

the sliding guide mechanism comprises moving rails and fixed rails, wherein the moving rails are connected with the bearing mechanism;

the bearing mechanism comprises a support part which is connected with the fixed rails and a bearing device for accommodating an object; T-shaped connectors are provided at two sides of an end of the bearing device; each of the T-shaped connectors comprises a clamping arm protruding from the end of the bearing device and a connecting arm located at a front end of the clamping arm; the support part has multiple mounting holes at two sides thereof; each of the mounting holes comprises a penetration hole, a connection hole and a clamping hole, wherein a length of the penetration hole is larger than or equal to a length of the clamping arm, a total length of the connection hole and the clamping hole is larger than or equal to a length of the connecting arm, and smaller than the length of the clamping arm;

the vertical displacement stopping system further comprises an auxiliary mechanism which comprises a support seat located on a box, a rotation shaft is rotatably connected with the support seat, the rotation shaft is connected with the bearing mechanism through a constant force spring;

the vertical displacement stopping system further comprises a buffer mechanism which comprises a rack located on the box, a gear engaged with the rack, and a buffer located on the bearing mechanism.

Beneficial Effects

After adopting such a structure, when the position of the bearing mechanism needs to be adjusted, it is only necessary to pull the handle which is provided at the front of the bearing mechanism to pull the positioning pin out of the positioning hole, and then move the bearing mechanism to the appropriate position under the action of the sliding guide mechanism, and then loosen the handle for inserting the positioning pin into the positioning hole to achieve locking, thereby achieving displacement stop. Moreover, the above operation is able to be performed at the door of the refrigerator, which is convenient to use.

DETAILED DESCRIPTION OF THE PREFERRED EMBODIMENT

Figure 1:
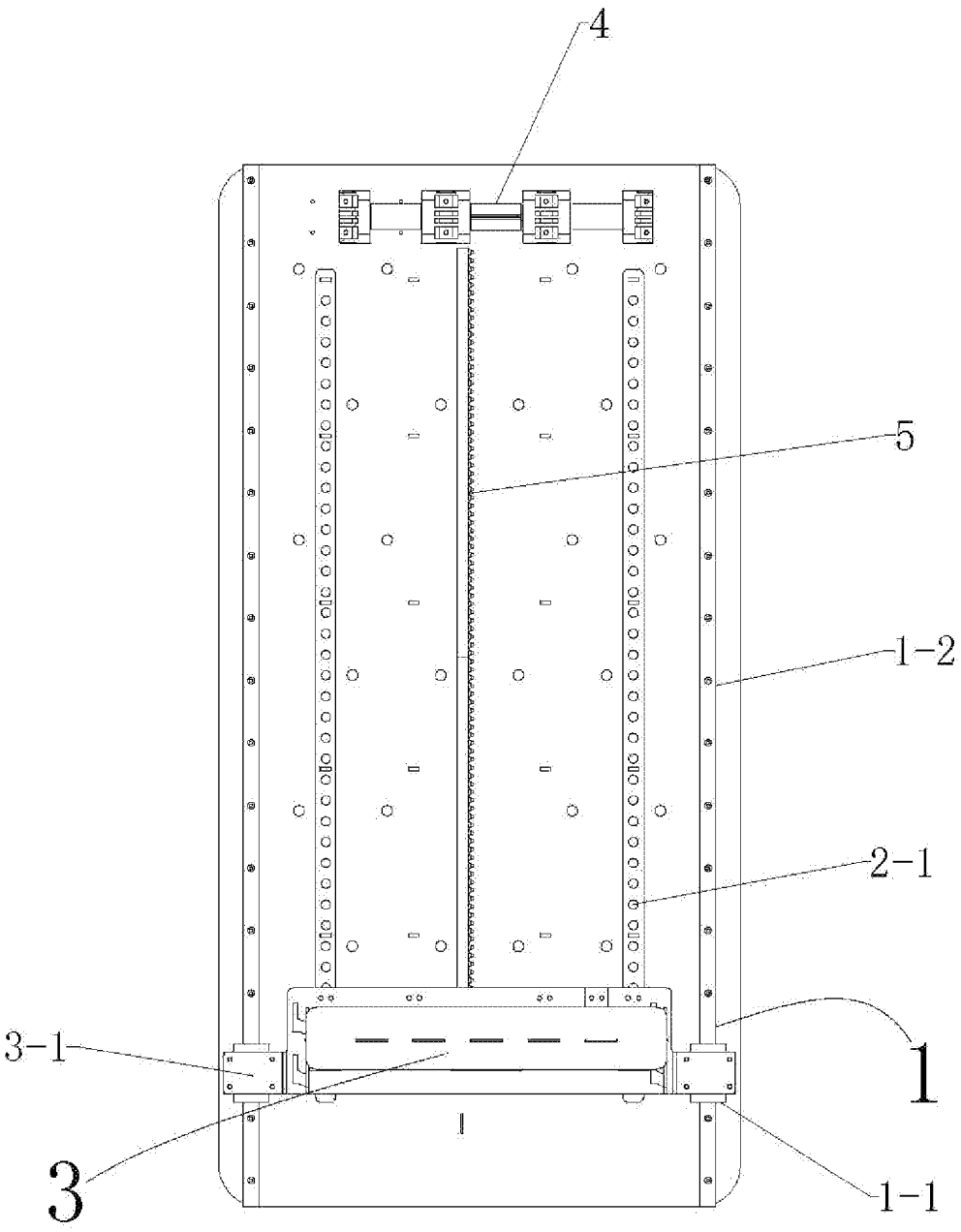
FIG. 1 is a main view of the present invention (wherein the constant force spring is omitted).
Figure 2:
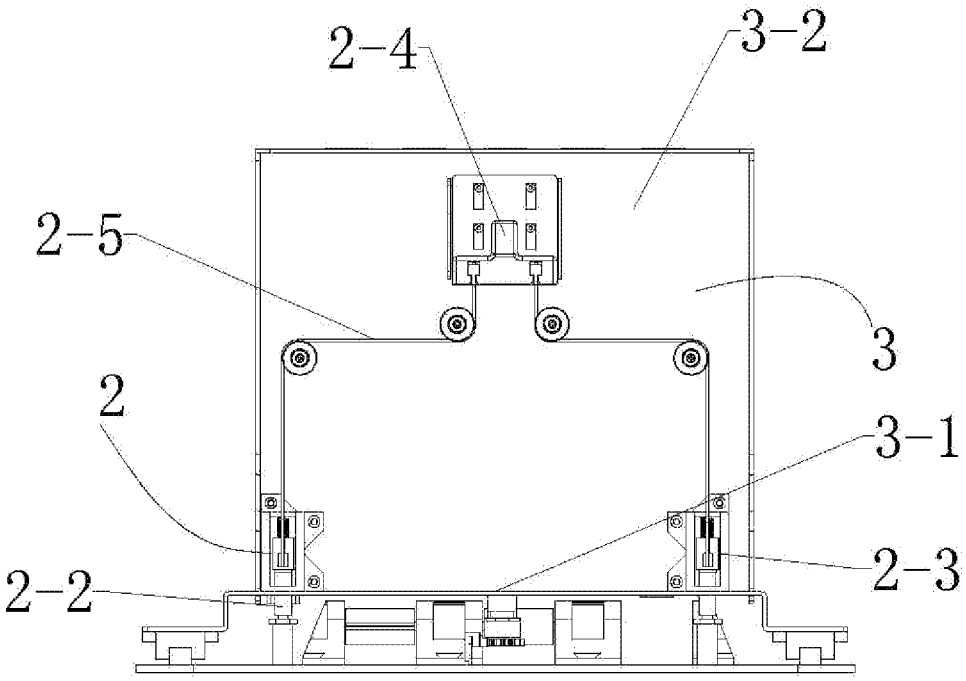
FIG. 2 is a bottom view of the present invention.
Figure 5:
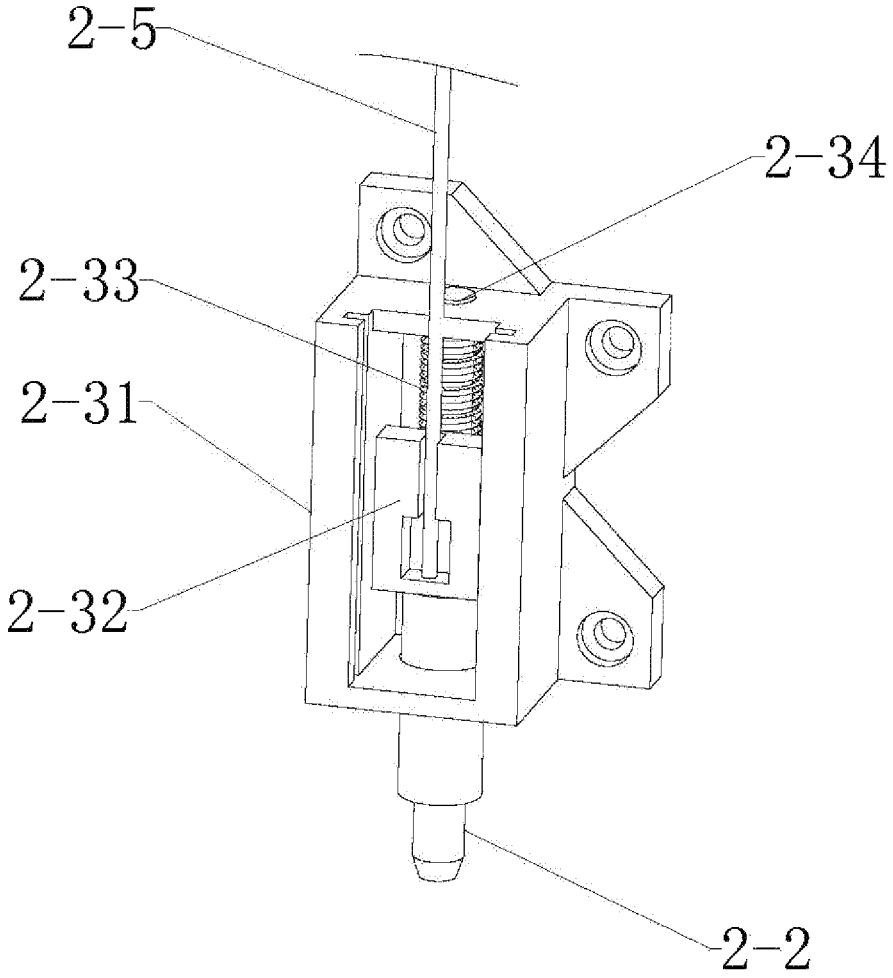
FIG. 5 is a structurally schematic view of a telescopic mechanism.
Figure 6:
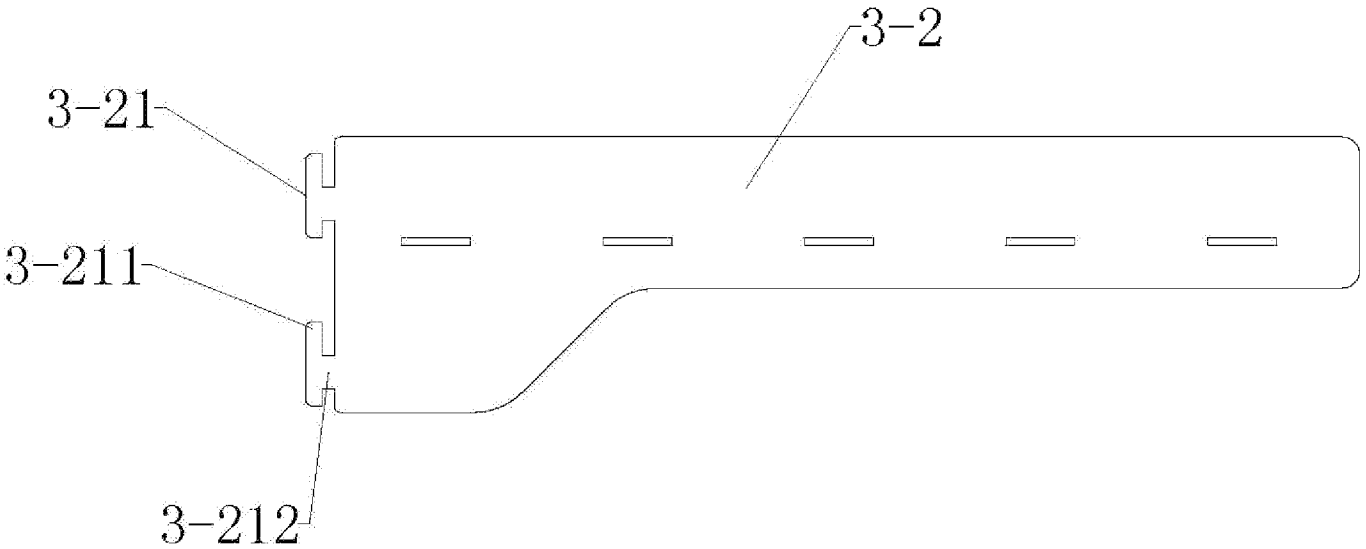
FIG. 6 is a structurally schematic view of a connector.
Figure 7:
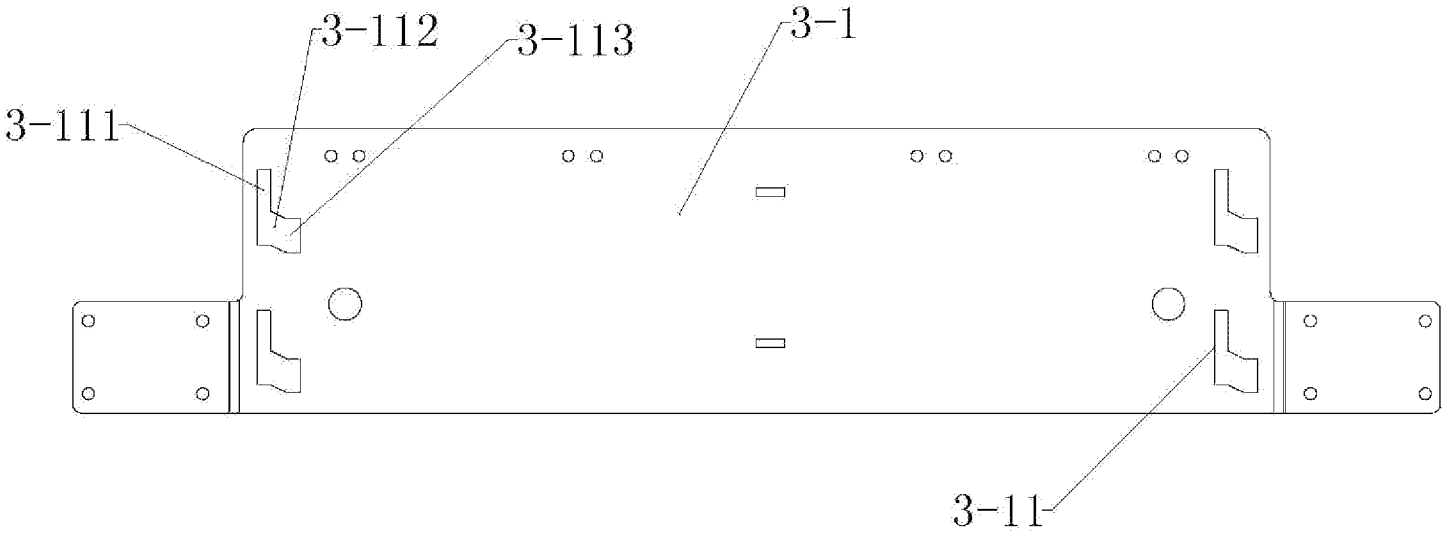
FIG. 7 is a structurally schematic view of a supporting part.

Referring to FIGS. 1, 2 and 5, a vertical displacement stopping system according to a preferred embodiment of the present invention is illustrated, which comprises a sliding guide mechanism 1, a locking mechanism 2 and a bearing mechanism 3, wherein the locking mechanism 2, having positioning holes 2-1, comprises positioning pins 2-2, telescopic mechanisms 2-3, and a handle 2-4 located at a front portion of the bearing mechanism 3. The handle 2-4 is connected with the positioning pins 2-2 through transmission parts 2-5, respectively; and preferably, the transmission parts 2-5 are flexible parts. Each of the telescopic mechanisms 2-3 comprises a housing 2-31 having a chamber, a movable block 2-32 located within the chamber, and a reset spring 2-33 located between a top portion of the movable block 2-32 and the housing 2-31, wherein each of the transmission parts 2-5 is connected with each of the positioning pins 2-2 through the movable block 2-32. Under a transmission action of the each of the transmission parts 2-5, the handle 2-4 drives the movable block 2-32 to move within the chamber, so as to drive the each of the positioning pins 2-2 to be detached from each of the positioning holes 2-1. When the handle 2-4 is loosened, under an action of the reset spring 2-33, the each of the positioning pins 2-2 enters the each of the positioning holes 2-1, thereby achieving displacement stopping. Even if the positioning pins are not aligned with the positioning holes, respectively, it is only required to slightly move the bearing mechanism 3 up or down for allowing the positioning pins to enter the positioning holes, which is convenient for operation. Moreover, the handle 2-4 is connected with the bearing mechanism 3 through a spring to facilitate resetting the handle 2-4, which is convenient for usage.

As shown in FIGS. 2 and 5, the handle 2-4 is slidably connected with a bottom of the bearing mechanism 3, the housing 2-31 is located at a bottom end of the bearing mechanism 3, each of the housing 2-31 and the bearing mechanism 3 has a through-hole for allowing the each of the positioning pins 2-2 to pass through, the movable block 2-32 is connected with a guide rod 2-34, the reset spring 2-33 is sleeved outside the guide rod 2-34 for avoiding twist of the reset spring, the housing 2-31 has another through-hole for allowing the guide rod 2-34 to pass through, the chamber of the housing 2-31 is able to be closed through moving a cover (which is not shown in the drawings).

Referring to FIGS. 1, 2, 6 and 7, the sliding guide mechanism 1 comprises moving rails 1-1 and fixed rails 1-2, wherein the moving rails 1-1 are connected with the bearing mechanism 3. The bearing mechanism 3 comprises a support part 3-1 which are connected with the fixed rails 1-2 and a bearing device 3-2 for accommodating an object. T-shaped connectors 3-21 are provided at two sides of an end of the bearing device 3-2. Each of the T-shaped connectors 3-21 comprises a clamping arm 3-211 protruding from the end of the bearing device and a connecting arm 3-212 located at a front end of the clamping arm 3-211. The support part 3-1 has multiple mounting holes 3-11 at two sides thereof. Each of the mounting holes 3-11 comprises a penetration hole 3-111, a connection hole 3-112 and a clamping hole 3-113, wherein a length of the penetration hole 3-111 is larger than or equal to a length of the clamping arm 3-211, a total length of the connection hole 3-112 and the clamping hole 3-113 is larger than or equal to a length of the connecting arm 3-212, and smaller than the length of the clamping arm 3-211. When each of the connectors 3-21 of the bearing device 3-2, such as a drawer, is inserted into the penetration hole 3-111, and then moves towards a side for allowing the connecting arm 3-212 of the each of the connectors 3-21 to be inserted into the clamping hole 3-113, so that the insertion installation of the bearing device 3-2 is achieved, which is convenient to use.

Figure 3:
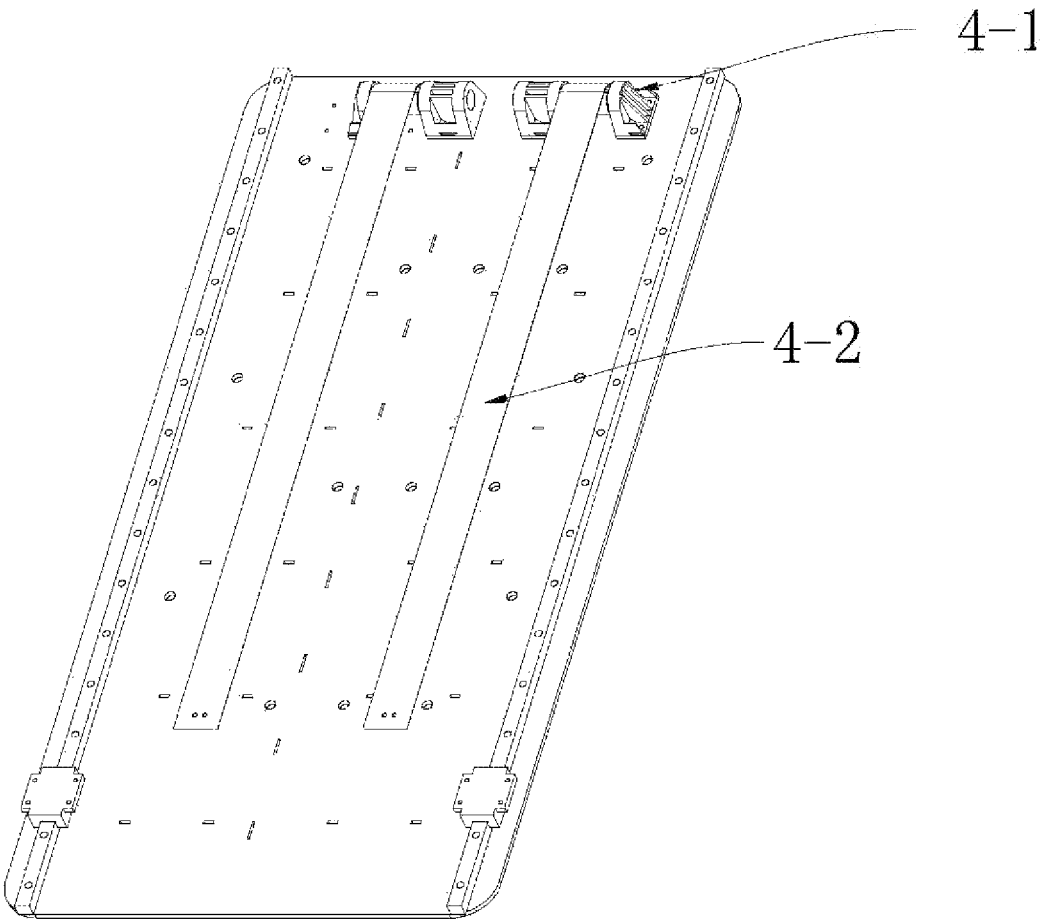
FIG. 3 is a structurally schematic view of an auxiliary mechanism.

Referring to FIG. 3, the vertical displacement stopping system further comprises an auxiliary mechanism 4 which comprises a support seat 4-1 located on a box. A rotation shaft is rotatably connected with the support seat 4-1 through a bearing, so that the rotation shaft is able to rotate more smoothly during rotation, and the sound is smaller. The rotation shaft is connected with the bearing mechanism 3 through a constant force spring 4-2, so as to provide an upward force at all times to facilitate the lifting of the bearing mechanism 3 when too many objects are placed, which is convenient to use.

Figure 4:
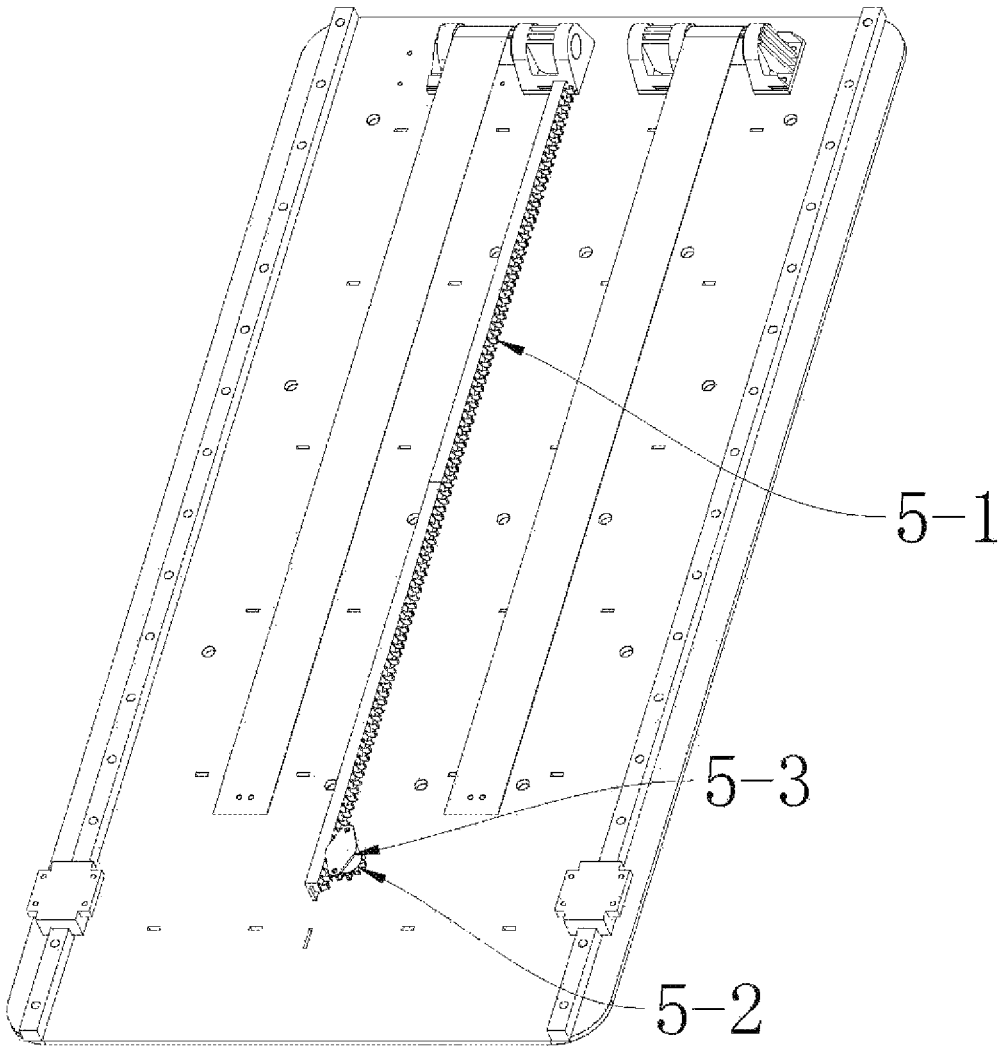
FIG. 4 is a structurally schematic view of a buffer mechanism.

Referring to FIG. 4, the vertical displacement stopping system further comprises a buffer mechanism 5 which comprises a rack 5-1 located on the box, a gear 5-2 engaged with the rack 5-1, and a bidirectional rotary buffer 5-3 located on the bearing mechanism 3. The bidirectional rotary buffer 5-3 moves up and down along the drawer. In the process of moving, under an action of the rack 5-1, the gear 5-2 rotates, so as to achieve a stable speed during the upward and downward movement.

The above are only preferred specific embodiments of the present invention, but the protection scope of the present invention is not limited thereto. Any change or replacement that is able to be easily conceived by one skilled in the art within the technical scope disclosed by the present invention should be covered by the protection scope of the present invention. Therefore, the protection scope of the present invention should be subject to the protection scope of the claims.

What is claimed is:

1. A vertical displacement stopping system, comprising a sliding guide mechanism, a locking mechanism and a bearing mechanism, wherein:

the locking mechanism, having positioning holes, comprises positioning pins, telescopic mechanisms, and a handle located at a front portion of the bearing mechanism, wherein the handle is connected with the positioning pins through transmission parts, respectively; each of the telescopic mechanisms comprises a housing having a chamber, a movable block located within the chamber, and a reset spring located between a top portion of the movable block and the housing, wherein each of the transmission parts is connected with each of the positioning pins through the movable block;

the handle is slidably connected with a bottom of the bearing mechanism, the housing is located at a bottom end of the bearing mechanism, each of the housing and the bearing mechanism has a through-hole for allowing the each of the positioning pins to pass through;

the movable block is connected with a guide rod, the reset spring is sleeved outside the guide rod, the housing has another through-hole for allowing the guide rod to pass through;

the sliding guide mechanism comprises moving rails and fixed rails, wherein the moving rails are connected with the bearing mechanism;

the bearing mechanism comprises a support part which is connected with the fixed rails and a bearing device for accommodating an object;

T-shaped connectors are provided at two sides of an end of the bearing device; each of the T-shaped connectors comprises a clamping arm protruding from the end of the bearing device and a connecting arm located at a front end of the clamping arm;

the support part has multiple mounting holes at two sides thereof; each of the mounting holes comprises a penetration hole, a connection hole and a clamping hole, wherein a length of the penetration hole is larger than or equal to a length of the clamping arm, a total length of the connection hole and the clamping hole is larger than or equal to a length of the connecting arm, and smaller than the length of the clamping arm.

2. The vertical displacement stopping system according to claim 1, further comprising an auxiliary mechanism which comprises a support seat located on a box, a rotation shaft is rotatably connected with the support seat, the rotation shaft is connected with the bearing mechanism through a constant force spring.

3. The vertical displacement stopping system according to claim 2, further comprising a buffer mechanism which comprises a rack located on the box, a gear engaged with the rack, and a bidirectional rotary buffer located on the bearing mechanism.

* * * * *